United States Patent [19]

Huston et al.

[11] 4,348,923

[45] Sep. 14, 1982

[54] METHOD FOR SEVERING PORTIONS FROM A PLURALITY OF FROZEN COLUMNS OF FISH OR THE LIKE

[75] Inventors: Larry Huston, Buffalo; Clifton H. Morrison, St. Paul; Glenn Rasmussen, Champlin; Takuzo Tsuchiya, Minneapolis, all of Minn.

[73] Assignee: General Mills, Inc., Minneapolis, Minn.

[21] Appl. No.: 276,145

[22] Filed: Jun. 22, 1981

Related U.S. Application Data

[62] Division of Ser. No. 43,978, May 31, 1979, Pat. No. 4,299,150.

[51] Int. Cl.[3] ..... B26D 3/20; B26D 1/06; B26D 7/06

[52] U.S. Cl. ..... 83/23; 83/42; 83/110; 83/113; 83/157; 83/409; 83/411 R; 83/411 A

[58] Field of Search ..... 83/23, 113, 110, 42, 83/409.2, 409, 411 A, 160, 419, 578, 622, 395

[56] References Cited

U.S. PATENT DOCUMENTS 2,583,940 1/1952 Furlong ..... 83/23

3,851,554 12/1974 Papai ..... 83/411 A 3,972,256 8/1976 Ross ..... 83/411 A X 4,186,543 2/1980 Lyell ..... 83/356.2

*Primary Examiner*—Donald R. Schran

*Attorney, Agent, or Firm*—Gene O. Enockson; L. MeRoy Lillehaugen; Stuart R. Peterson

[57] ABSTRACT

A plurality of frozen fish columns having a rectangular cross section are contained in a corresponding number of transversely aligned and laterally spaced tubes constituting a magazine. The lower ends of the columns rest on pushers which are slidable on a number of plastic anvils or blocks comprising part of a vertically adjustable table assembly. A single-edge blade is advanced and retracted at a 30° angle through the lower ends of the frozen columns to sever portions therefrom having a thickness determined by the vertical adjustment of the table assembly. Pushers, which are synchronized with the blade movement, shove the severed portions from the cutting station beneath the lower ends of the tubes onto a conveyor. By controlling the speed of the conveyor the various severed portions, while still uniformly oriented, are transferred in an appropriately spaced end-to-end relationship to another location for processing.

6 Claims, 8 Drawing Figures

METHOD FOR SEVERING PORTIONS FROM A PLURALITY OF FROZEN COLUMNS OF FISH OR THE LIKE

This is a division of application Ser. No. 043,978, filed May 31, 1979, now U.S. Pat. No. 4,299,150.

BACKGROUND OF THE INVENTION

1. Field of the Invention

This invention relates generally to the cutting of frozen food, and pertains more particularly to a method and apparatus for severing relatively thick portions from a plurality of columns or logs of frozen fish or the like.

2. Description of the Prior Art

Cutting off the ends of frozen fish logs or columns has been done for a number of years. Sometimes the logs or columns are sawed into portions having the desired thickness. However, when resorting to a sawing action, there results an appreciable amount of "sawdust" which, while reclaimable, nonetheless reduces the number of portions that can be obtained from each column or log.

While the so-called sawdust is not a complete loss, nonetheless it does not command the price that it would if it could be sold in intact portions. Therefore, power-operated cleavers or knives have been employed. One prior art apparatus known to us is disclosed in U.S. Pat. No. 3,867,858, granted on Feb. 25, 1975 to Tsuchiya et al. While this prior art apparatus has performed admirably in actual practice, it has a distinct disadvantage in that the severed portions of frozen fish are not uniformly oriented, or at least are not arranged in a pattern suitable for performing food processing operations thereon, such as breading and battering the severed product. Also, the apparatus just alluded to is somewhat limited to the rate at which the portions can be sliced from the frozen columns or logs of fish. Still further, the Tsuchiya et al apparatus is not capable of cutting off relatively thick portions, which are frequently desirable and which are used in so-called fishburgers.

SUMMARY OF THE INVENTION

Accordingly, an important object of the present invention is to cut or sever relatively thick portions from a number of columns or logs of frozen fish or the like and doing so in a manner such that the sevefed portions are of a uniform thickness.

Another object of our invention is to sever portions of fish from a frozen column in which the severed portions are uniformly oriented and which orientation or arrangement is suitable for the further processing of the portions, such as breading and battering the portions.

A further object is to virtually eliminate the curl that has heretofore been imparted to the fish portions due to the cutting thereof, and at the same time to minimize appreciably the degree of breakage of the portions. More specifically, it is within the contemplation of the present invention to not only reduce curl and any breakage, but to minimize waste which has attended some prior art cutting operations, particularly those involving a sawing action in which dust or powder results from the sawing of the frozen product.

Yet another object of our invention is to enable a relatively large number of frozen columns or logs of fish to be cut at the same time, thereby increasing the production rate and rendering the invention especially suited for largescale packaging of frozen fish.

Still further, the invention has for an object the providing of apparatus that is rugged, reliable, long lasting and which will require very little downtime for maintenance and repair purposes.

Briefly, our invention comprises a rigid table assembly which can be adjusted vertically beneath the lower ends of a magazine comprised of a preferred number of vertically arranged tubes, each tube containing therein a frozen column or log of fish or the like. The various tubes have a cross section corresponding to the cross section of the column of fish contained therein. Different column cross sections can be accommodated by inserting an appropriate spacer into each tube. The tubes are transversely aligned and laterally spaced so that the severed portions of the fish have a desired spacing therebetween. By reason of the vertical adjustability of the table assembly, the thickness of the portions can be varied, this being easily done without stopping the apparatus.

A cutter blade having a beveled knife edge is advanced and retracted at a 30° angle with respect to the transversely arranged tubes, the blade passing directly beneath the lower end of each tube so as to sever a portion having a thickness determined by the adjustment of the table assembly. The lower ends of the various frozen columns rest on so-called pushers which are withdrawn as the cutter blade advances to effect its cutting action. The table assembly includes relatively thick plastic blocks or anvils, there being one beneath each tube, on which the pushers slide so that each severed portion then rests on its particular plastic anvil. When the blade is retracted afer effecting a complete cut, then the pushers act against the severed fish portions to displace them from the cutting station beneath the lower ends of the tubes, doing so in a direction toward a conveyor assembly. Whereas the first group of severed portions are only displaced from beneath the tubes, the next set of severed portions act against the preceding set of portions to move the preceding set onto the conveyor assembly while still oriented in the same uniform end-to-end manner in which they were severed from the columns or logs. The conveyor assembly conveys the uniformly oriented portions to a station spaced from the station where they were severed for further processing; the speed of the conveyor assembly can be increased or decreased to vary the end-to-end spacing between the portions being conveyed.

BRIEF DESCRIPTION OF THE DRAWINGS

FIG. 1 is an elevational view taken from one end of the apparatus exemplifying our invention;

FIG. 6 is a vertical sectional view taken along the irregular line 6—6 of FIG. 1 for the purpose of showing how the lower end of a frozen fish column or log is supported, the cutter blade being retracted to the position in which it appears in FIGS. 2 and 3;

DESCRIPTION OF THE PREFERRED EMBODIMENT

Figure 2:
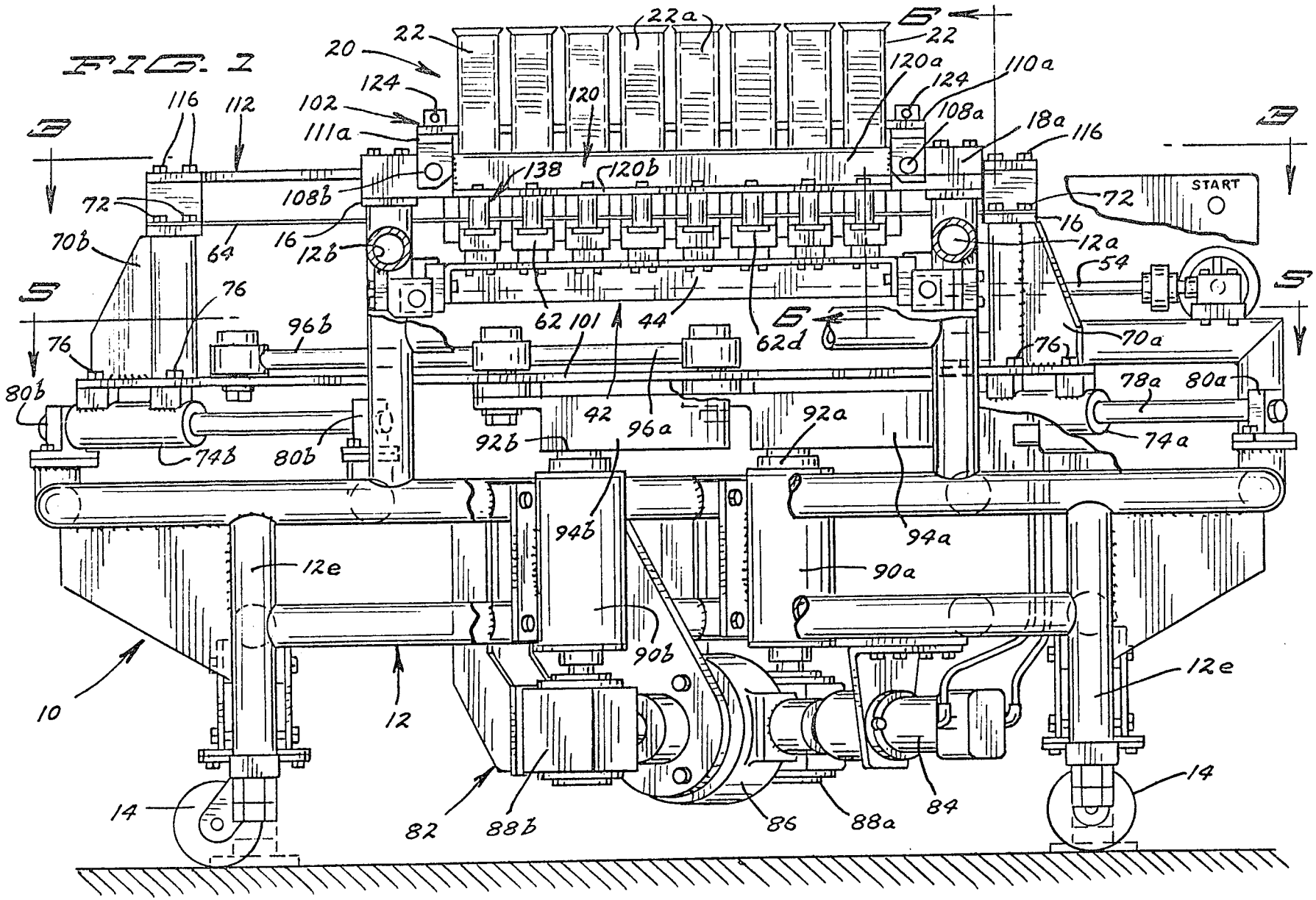
FIG. 2 is a top plan view of the apparatus depicted in FIG. 1, the view showing the cutter blade retracted in preparation for initiating a cutting stroke.
Figure 2:
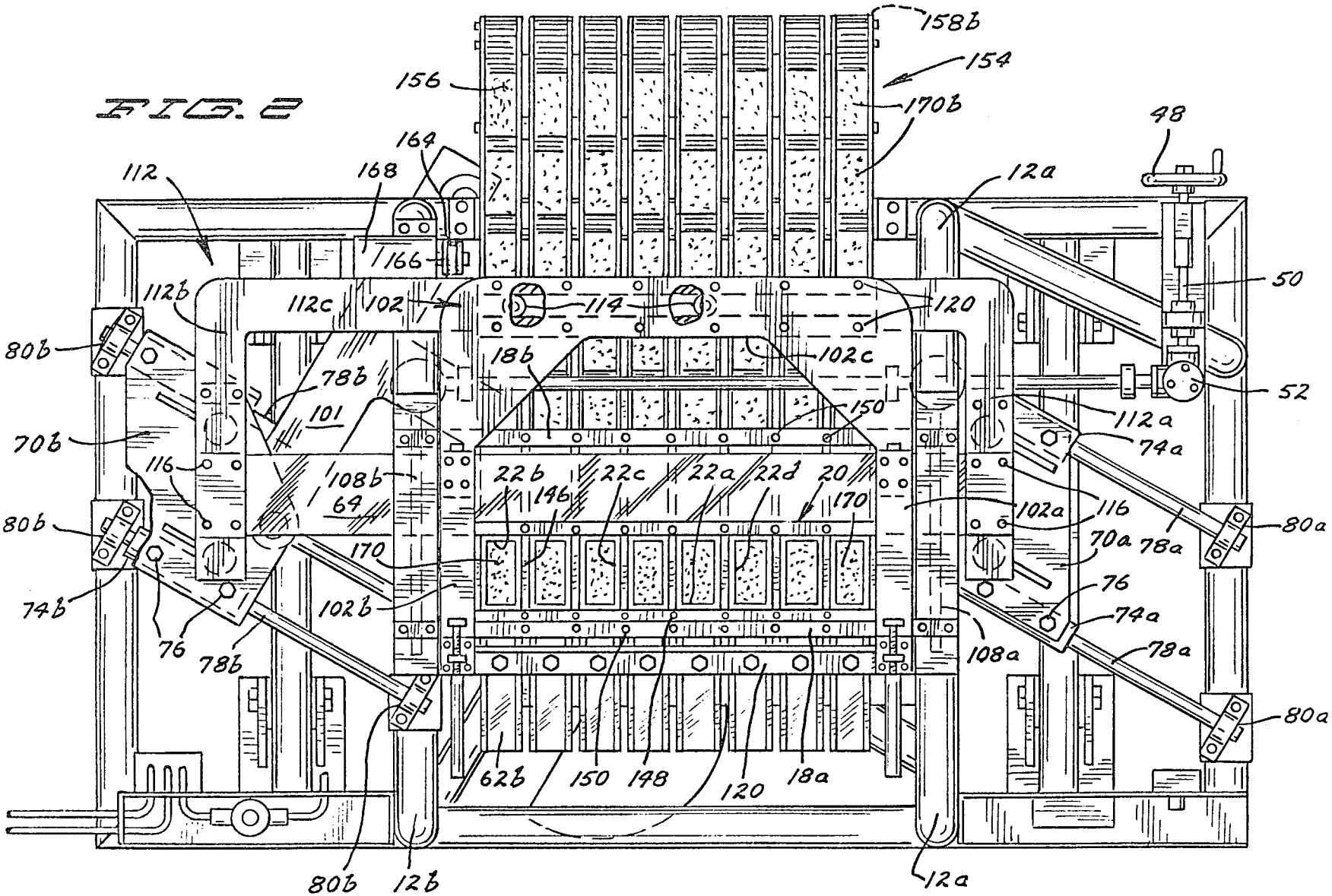

Referring now in detail to the drawings, the apparatus selected to illustrate our invention has been denoted generally by the reference numeral 10. As can be seen in FIG. 1, the apparatus includes a magazine composed of a number of tubular members that are suitably welded together. While the frame constitutes no real part of our invention, nonetheless it is designed in a manner such that it provides adequate support for a number of components that will be described; therefore, it will be of some benefit in presenting the ensuing description to assign reference characters to some of the supporting members that will be later referred to. Accordingly, it will be noted that the frame 12 includes generally horizontal tubular members 12*a*, 12*b*, 12*c* and 12*d*. Additionally the frame the downwardly extending tubular legs 12*e*. At the lower ends of the legs 12*e* are casters 14 so that the apparatus can be readily moved from one vantage location within a processing plant to another.

Having mentioned the tubular members 12*a*, 12*b*, it can now be pointed out that these members have support pads 16 attached thereto. More specifically, there are two such pads 16 carried by the tubular member 12*a* and two such pads 16 carried by the tubular member 12*b*. What will be termed mounting bars 18*a* and 18*b* are bolted to the support pads 16, being parallel to each other and serving a purpose now to be explained.

The mounting bars 18*a*, 18*b* support a magazine 20 composed of a number (eight in the illustrative case) of vertical tubes 22 having a rectangular cross section. More specifically, each tube has relatively narrow sides labeled 22*a*, 22*b* and relatively wide sides labeled 22*c*, 22*d*. It will be observed that the various tubes 22 are transversely aligned and laterally spaced. This is achieved, although it can be accomplished in other ways, by means of a pair of strips 24 welded to the relatively narrow sides 22*a* and 22*b*, the ends of the strips 24 being attached or supported by the previously mentioned mounting bars 18*a* and 18*b*. The various tubes 22 are open at the top and bottom, the upper ends being flared for the reception of the frozen columns or frozen logs of fish yet to be referred to. All that really need be understood at this point is that the magazine 20 composed of the various tubes 22 is a single unit and that it is fixedly mounted on the frame 12. In actual practice, additional strips corresponding to the strips 24 are welded to the narrow sides 22*a* and 22*b* in order to impart greater rigidity to the overall magazine construction.

Welded to the undersides of the tubular members 12*a* and 12*b* are ears or lugs 26 that extend downwardly, each ear or lug 26 having a bearing block 28 secured thereto. The bearing blocks 28 rotatably journal a threaded shaft or lead screw 30 having oppositely pitched threaded sections 32*a* and 32*b*, as can be readily seen in FIGS. 6 and 7. In threaded engagement with the section 32*a* is a slide block 34*a*, and similarly in engagement with the threaded section 32*b* is a slide block 34*b*. The blocks 34*a* and 34*b*, there being one at each side of the apparatus 10, have an integral cam strip 36 formed thereon with upper and lower inclined edges 36*a* and 36*b*. The cam strips 34 are best seen in FIG. 8 because portions of the bearing blocks 28 have been broken away in order to reveal the cam strips 36; however, their upper and lower inclined edges 36*a* and 36*b* are best understood from FIG. 7.

The cam strips 36 are slidably received in angled grooves 38 formed in a pair of track members 40 which are bolted to opposite sides of what will be termed a table assembly 42; more specifically to a table 44 which is part of the table assembly 42. The table 44 can be adjusted vertically by rotating the lead screws 30 in a manner now to be described.

Figure 3:
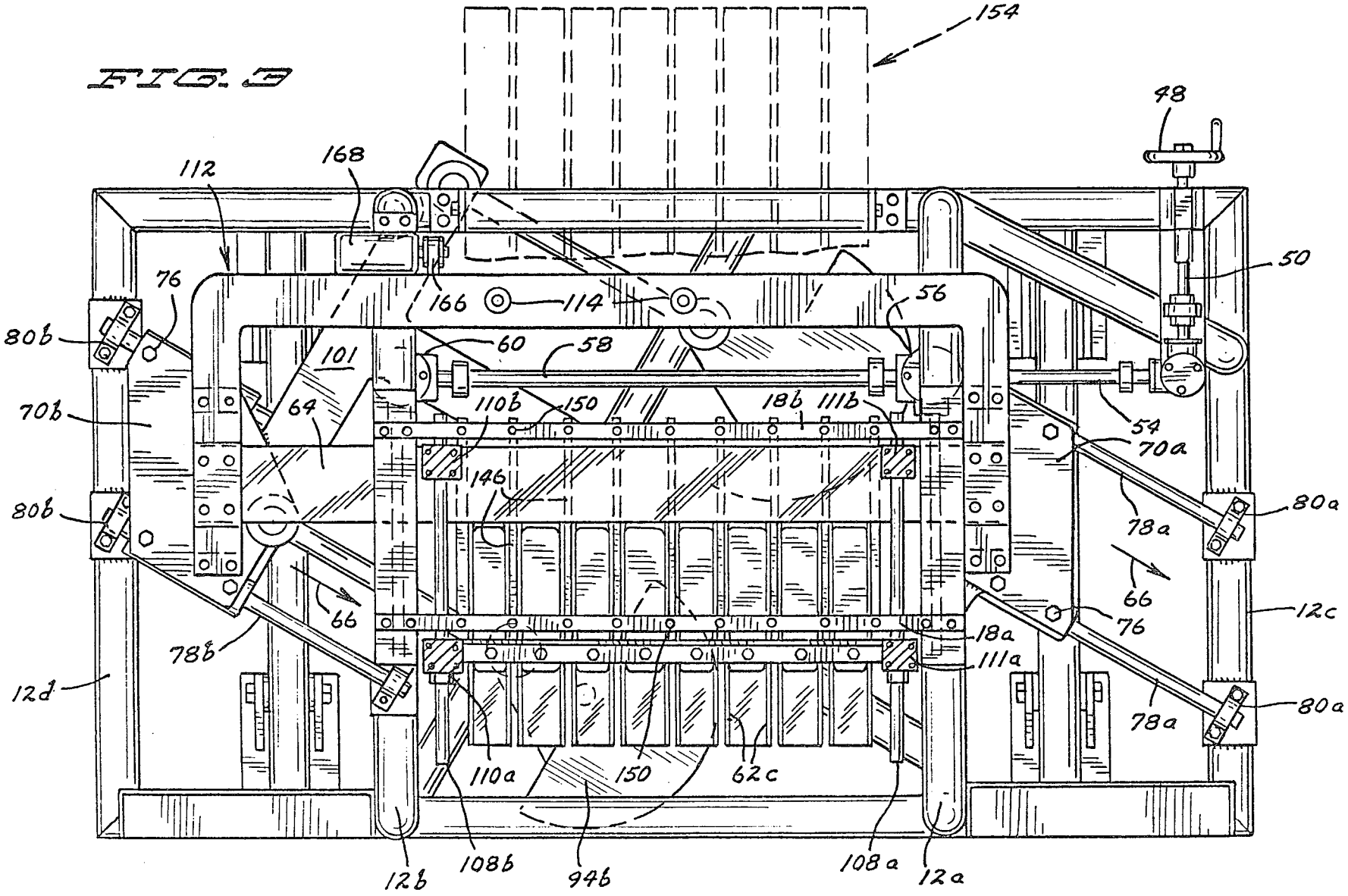
FIG. 3 is a horizontal view, partly in section, taken in the plane of the line 3—3 of FIG. 1, the cutter blade being in the same retracted position as shown in FIG. 2.

Accordingly, it will be noted that each lead screw or shaft 30, there being one at each side of the apparatus, is rotatable in its bearing blocks 28 via an adjusting shaft 46 keyed to each lead screw 30. The adjusting shafts 46 are rotated by a hand wheel 48 having a shaft 50 coupled to a right angle drive 52, as can be seen in FIG. 3. The right angle drive is in turn coupled to a transverse shaft 54 connecting with a T drive 56, one leg of the T drive 56 connecting to the lead screw 46 at one side of the apparatus 10. The other leg of the T drive 56 connects with still an additional transverse shaft 58 having an angle drive 60 which is coupled to the adjusting shaft 46 at the other side of the apparatus.

It will thus be appreciated that the hand wheel 48, when rotated, causes both of the adjusting shafts 46 to be rotated with the consequence that the slide blocks 34*a* and 34*b* are threadedly moved toward each other to lower the table assembly 42 because of the movement of the cam strips 36 in the angled grooves 38. The converse is true when the slide blocks 34*a* and 34*b* are moved apart, the table assembly 42 then being raised. The benefits to be derived from the use of the adjusting mechanism just described will become clear as the description progresses.

Referring in greater detail to the construction of the table assembly 42, it will be understood that in addition to the base table 44 which is quite thick and therefore quite rigid, the assembly 42 further includes a plurality of plastic blocks or anvils 62, there being one beneath each of the tubes 22 of the magazine 20. The various anvils 62 are fastened to the base table 44 by means of bolts 64. Consequently, the anvils 62 become an integral part of the assembly 42 and are raised and lowered in unison when the base table 44 is raised or lowered through the agency of the hand wheel 48, as already described. The blocks or anvils 62 are specially configured for a purpose hereinafter made manifest. At this stage of the description, though, it can be pointed out that each anvil 62 has a flat surface 62*a* and a longitudinal groove 62*b* formed by inturned flanges 62*c* at each side, the flanges 62*c* being raised so as to form tracking grooves 62*d* which will be described with greater particularity hereinafter.

It should be specifically understood that the table assembly 42 is stationary, although it can be adjusted vertically up and down as already explained.

At this time, attention is directed to a flat, relatively thin cutter blade 64 having a beveled knife edge 64*a* extending from end to end, or substantially from end to end, of the blade 64. The cutter blade 64 is longer than the transverse length of the magazine 20 and so is its beveled knife edge 64*a*. In this way, the cutter blade 64 can pass under all of the tubes 22 forming the magazine 20. Actually, as can be discerned from FIG. 7, the upper surface of the blade 64 is in close proximity to the lower end of each of the tubes 22.

Figure 4:
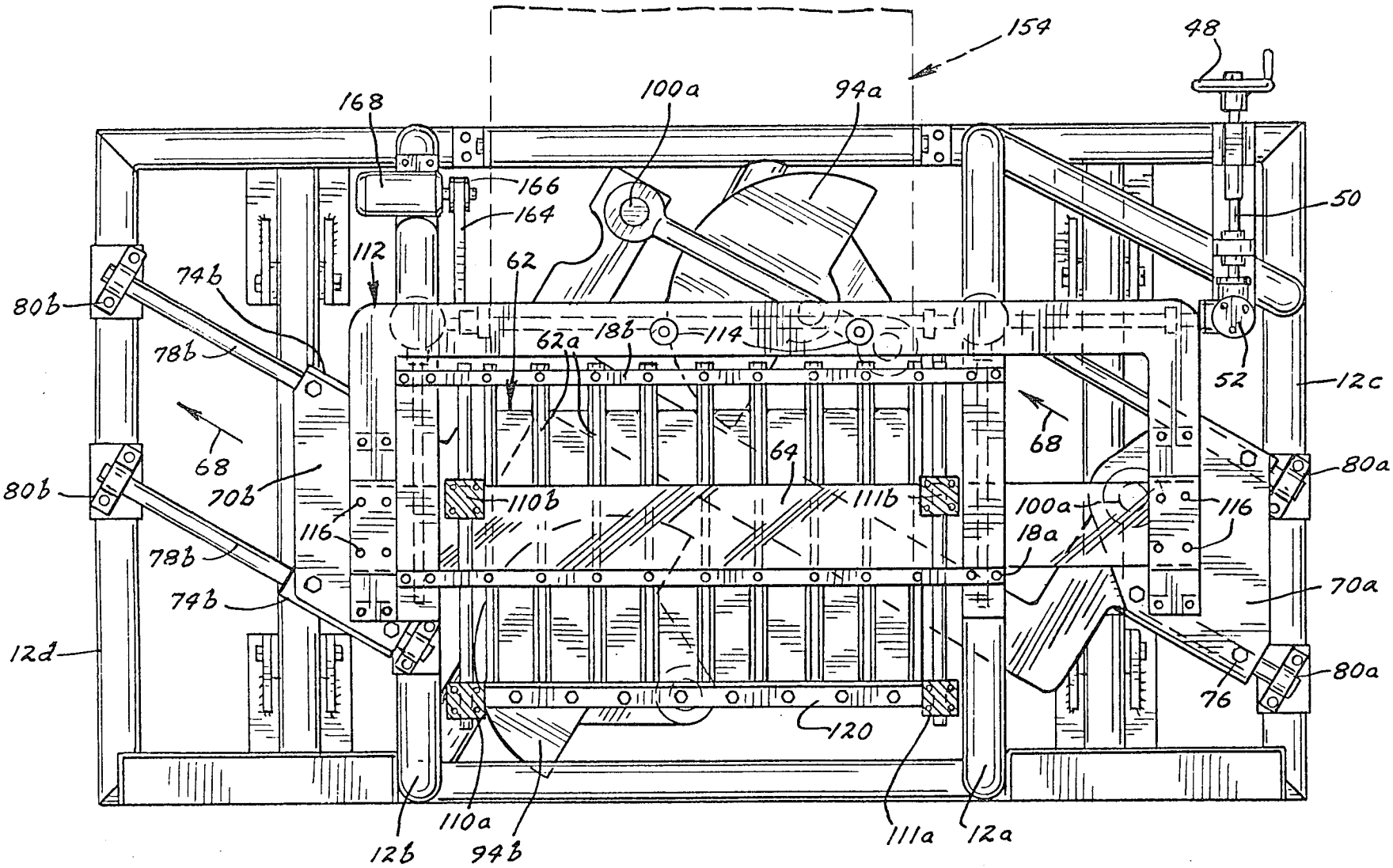
FIG. 4 is a view corresponding to FIG. 3 but with the cutter blade illustrated in the position it assumes after effecting a cutting or severing operation.

It might be of benefit at this stage of the description to explain that the blade 64 is advanced in the direction of the arrows 66 shown in FIG. 3 and retracted in the direction of the arrow 68 set forth in FIG. 4. Thus, whereas the magazine 20 is arranged transversely with respect to the apparatus, the angle of movement, more specifically 30°, of the blade 64 is not perpendicular or at right angles to the magazine 20.

Having mentioned that the blade 64 is advanced and retracted in the direction of the arrows 66 and 68, respectively, the manner in which the blade 64 is so advanced and retracted will now be described. A pair of blade supports 70*a* and 70*b*, as can best be seen in FIG. 1, have the ends of the blade 64 attached thereto as by bolts 72. The lower end of the blade support 70*a* is provided with a pair of sleeve bearings 74*a*, whereas the lower end of the blade support 70*b* is similarly provided with a pair of sleeve bearings 74*b*. Bolts 76 are employed for anchoring the various sleeve bearings 74*a*, 74*b* to the lower ends of the blade supports 70*a*, 70*b*.

In order to constrain the movement of the blade 64, and its supports 70*a*, 70*b* in the direction of the arrows 66 and 68, a pair of bearing shafts 78*a* have the sleeve bearings 74*a* slidably encircling same, and in a similar fashion a pair of bearing shafts 78*b* have the sleeve bearings 74*b* slidably encircling same. The opposite ends of the bearing shafts 78*a* are fixedly anchored in shaft supports 80*a*, whereas the opposite ends of the bearing shafts 78*b* are anchored in shaft supports 80*b*. The various shaft supports 80*a* and 80*b* are mounted on tubular members constituting a part of the frame 12. All that need be taken into account is that the bearing shafts 78*a* and 78*b* are angled so as to impart the angled movement of the blade 64 back and forth in the direction of the arrows 66 and 68.

Figure 5:
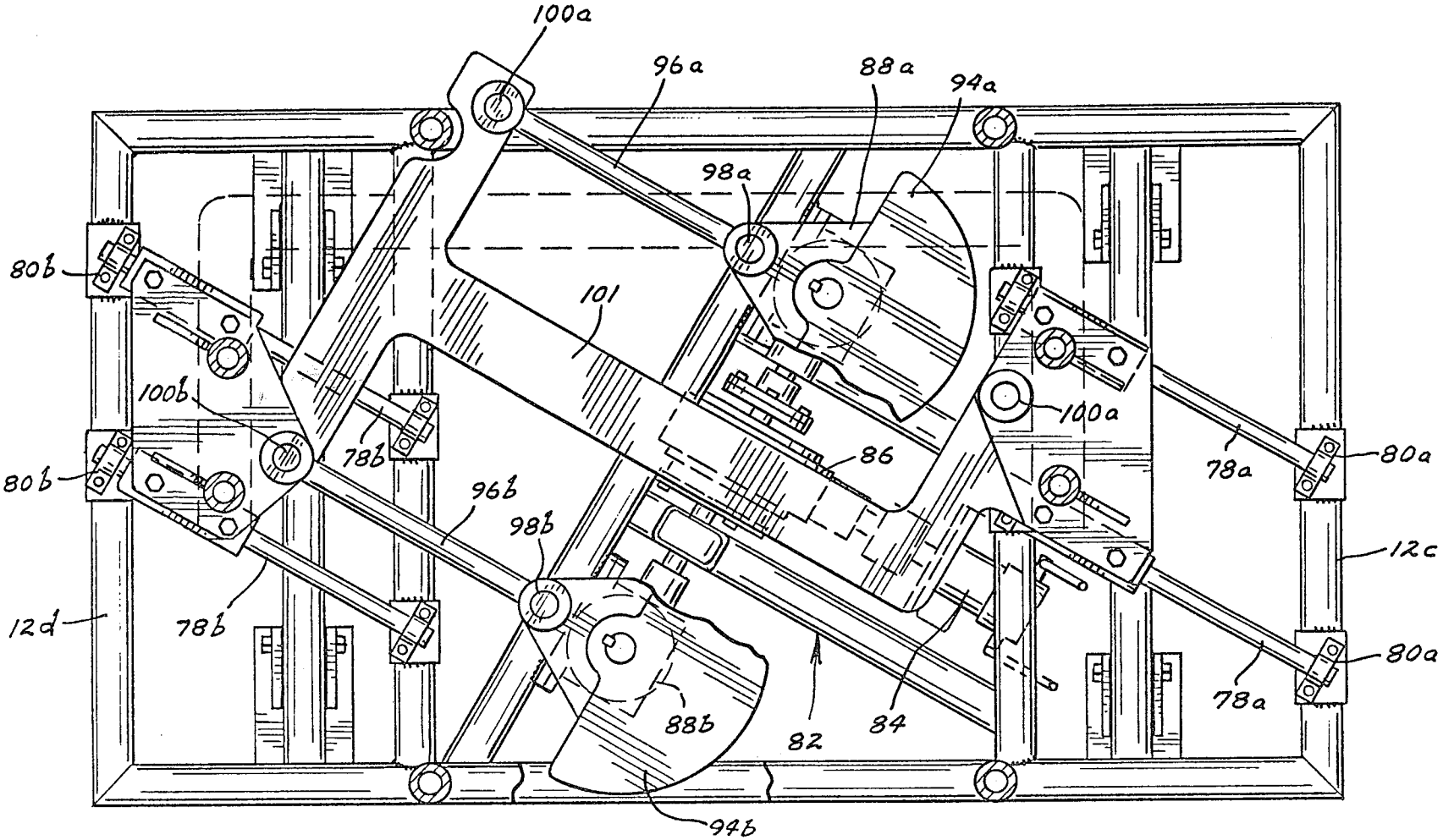
FIG. 5 is another sectional view, this view being taken in the direction of line 5—5 of FIG. 1 for the purpose of showing to better advantage the drive mechanism for the apparatus.
Figure 5:
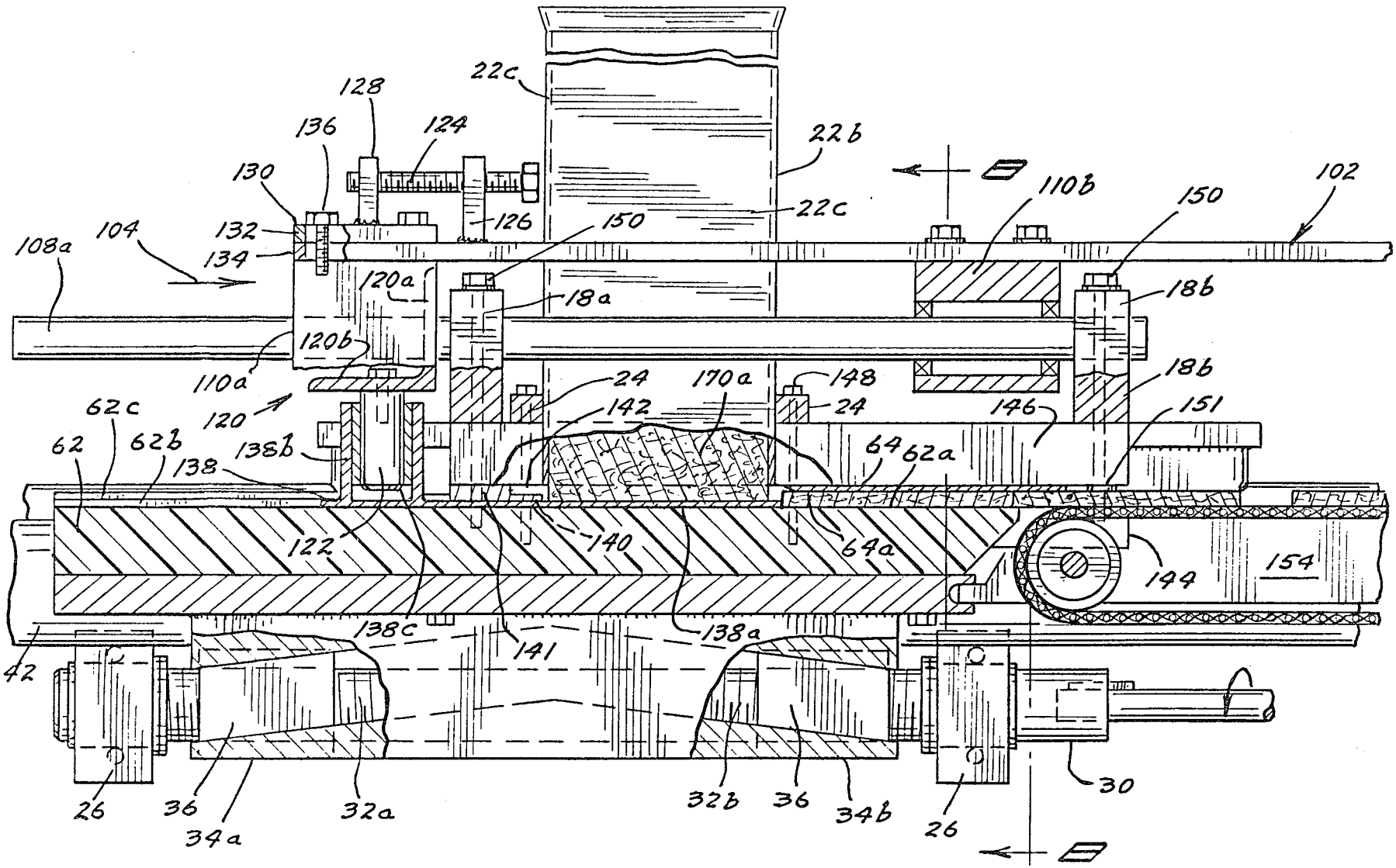

Describing now the drive mechanism indicated generally by the reference numeral 82 for the blade supports 70*a* and 70*b*, the drive mechanism 82 is best understood from FIG. 5. Thus, the mechanism 82 includes a hydraulic motor 84, and coupler 86 having oppositely issuing shafts connecting with first and second angle drives 88*a* and 88*b*. The components 84, 86, 88*a* and 88*b* are also appearing in FIG. 1. It perhaps can better be seen that the angle drive 88*a* connects with a drive bearing assembly 90*a* and the angle drive 88*b* with a drive assembly 90*b*. The drive assembly 90*a* has a shaft 92*a* extending upwardly with a counterweight 94*a* rotatably carried thereon; the drive assembly 90*b* has a shaft 92*b* extending upwardly with a counterweight 94*b* mounted thereon. The counterweight 94*a* is connected to a connecting rod or arm 96*a* via a crank pin 98*a* and the other end of the connecting arm 96*a* has a pin 100*a* connecting with a yoke or tie strip 101. Similarly, the counterweight 94*b* has a connecting rod or arm 96*b* connected thereto through the agency of a crank pin 98*b*, the end of the crank arm opposite from the pin 98*b* having a pin 100*b* which connects the arm 96*b* to the yoke or tie strip 101. As can be seen from FIG. 5, the yoke or tie strip 101 connects the two blade supports 70*a*, 70*b* together so that the two supports 70*a*, 70*b* move in synchronism as a single unit.

Mounted for rectilinear movement in a horizontal plane above the blade supports 70*a* and 70*b* is a U-shaped cam plate 102 composed of leg sections 102*a*, 102*b* and a connecting bight section 102*c*. The cam plate 102 is constrained for reciprocal movement in the direction of the arrow 104 in FIG. 6 and the arrow 106 in FIG. 7 by means of a pair of fixed shafts or rails 108*a* and 108*b* anchored in the previously mentioned mounting bars 18*a* and 18*b*. As can be seen from FIGS. 6 and 7, a pair of bearing blocks 110*a* and 110*b* are fixed to the underside of the leg section 102*a*, and a similar pair of such blocks 111*a* and 111*b* are affixed to the underside of the other leg section 102*b* of the cam plate 102. The blocks 110 beneath the leg section 102*a* slidably encircle the shaft or rail 108*a*, whereas the blocks 111 beneath the leg section 102*b* slidably encircle the other shaft or rail 108*b* in order to guide the cam plate 102 back and forth in the direction of the arrows 104 and 106.

Although better understood from the description yet to be presented, the movement of the cam plate 102 is synchronized with the movement of the blade supports 70*a* and 70*b*. Of course, the purpose of the blade supports is to carry the cutter blade 64 which is fixedly fastened to the upper ends of the blade supports 70*a*, 70*b*.

Having mentioned that the movement of the cam plate 102 is synchronized with the movement of the blade supports 70*a* and 70*b*, it will now be explained that what will be termed a U-shaped cam roller support 112 having leg sections 112*a*, 112*b* and a bight or connecting section 112*c* is also carried atop the blade supports 70*a* and 70*b*, actually confronting the upper end surfaces of the cutter blade 64 as can be understood from FIG. 1. Holding the U-shaped cam roller support 112 in place on the upper ends of the blade spports 70*a* and 70*b* are bolts 116. In order to expose two rollers 114 to view, these rollers being mounted for rotation on the bight section 112*c* of the U-shaped cam roller support 112, portions of the overlying bight section 102*c* have been removed in FIG. 2. However, these rollers 114 are readily seen from FIGS. 3 and 4. It can be pointed out at this stage of the description that the rollers 114 extend upwardly into a cam track formed by two parallel strips 118 secured to the underside of the bight section 102*c* by means of bolts 120. Consequently, even though the blade 64 is moved angularly, owing to the direction in which the shafts 78*a*, 78*b* extend, the cam plate 102 is moved back and forth in a direction perpendicular to the magazine 20. Stated somewhat differently, the rollers 114 are free to move between the strips 118 constituting a cam track and because of the transverse direction in which the strips 118 extend, no transverse component of movement is transferred to the cam plate 102, even though the roller support 112 moves at an angle. Thus, the shafts or rails 108*a* and 108*b* function to guide the cam plate 102 in a direction perpendicular to the direction in which the magazine 20 is mounted. Of course, it will be understood that while the cutter blade 64 is moved angularly in order to impart a slicing-like movement to the beveled knife edge 64*a*, the knife edge 64*a* remains parallel to the magazine 20, and hence the bight section 112*c* of the U-shaped cam roller support 112 moves parallel to the knife edge 64*a*. More will be said hereinafter concerning the movement of the blade 64 in the performance of its cutting action.

It has already been mentioned that a pair of bearing blocks 110*a*, 110*b* slidably encircle the shaft or rail 108*a* and a similar pair of bearing blocks 111*a*, 111*b* slidably encircle the other shaft or rail 108*b*. From FIGS. 6 and 7, it can be appreciated that the particular block 110*a* shown at the left, and there is a similar such block 111*a* transversely aligned therewith, has one end of an angle iron 120 secured thereto, such as by bolts. The other end of the angle iron 120 is anchored to the particular block 111*a* that is in transverse alignment with the block 110*a* at the left in FIGS. 6 and 7. The angle iron 120 has a vertical flange 120*a* and a horizontal flange 120*b*. Bolted to the underside of the horizontal flange is a series of downwardly extending pusher pins 122, there being one such pin 122 for each of the tubes 22 collectively constituting the magazine 20. One such pusher pin 122 has been shown in FIGS. 6 and 7. The specific role played by these various pusher pins 122, as they have been termed, is better reserved for a more complete description to be given hereinafter.

Figure 7:
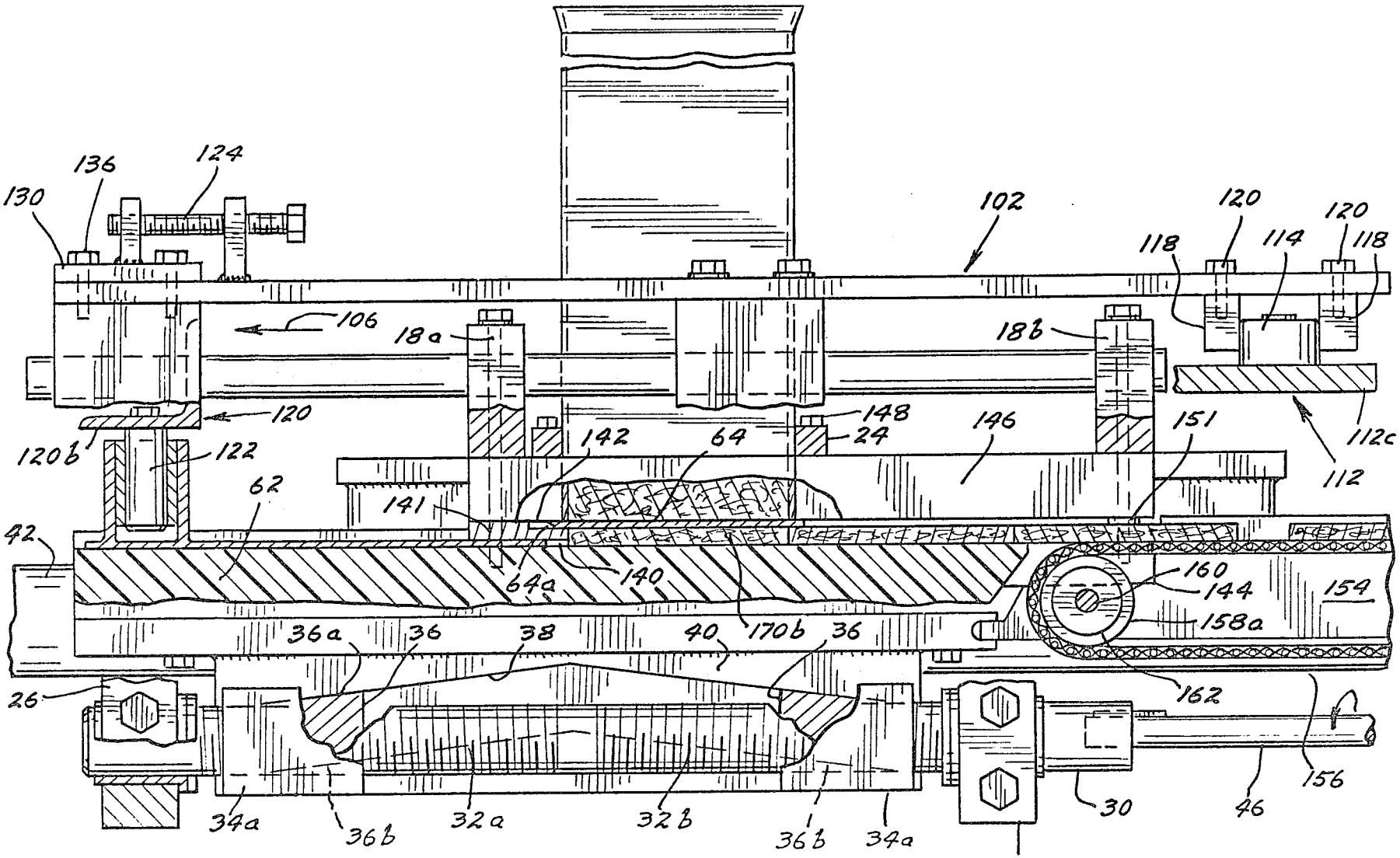
FIG. 7 is a view corresponding to FIG. 6 but with the cutter blade pictured in the position shown in FIG. 4, which is after a fish portion as been severed from its column.
Figure 8:
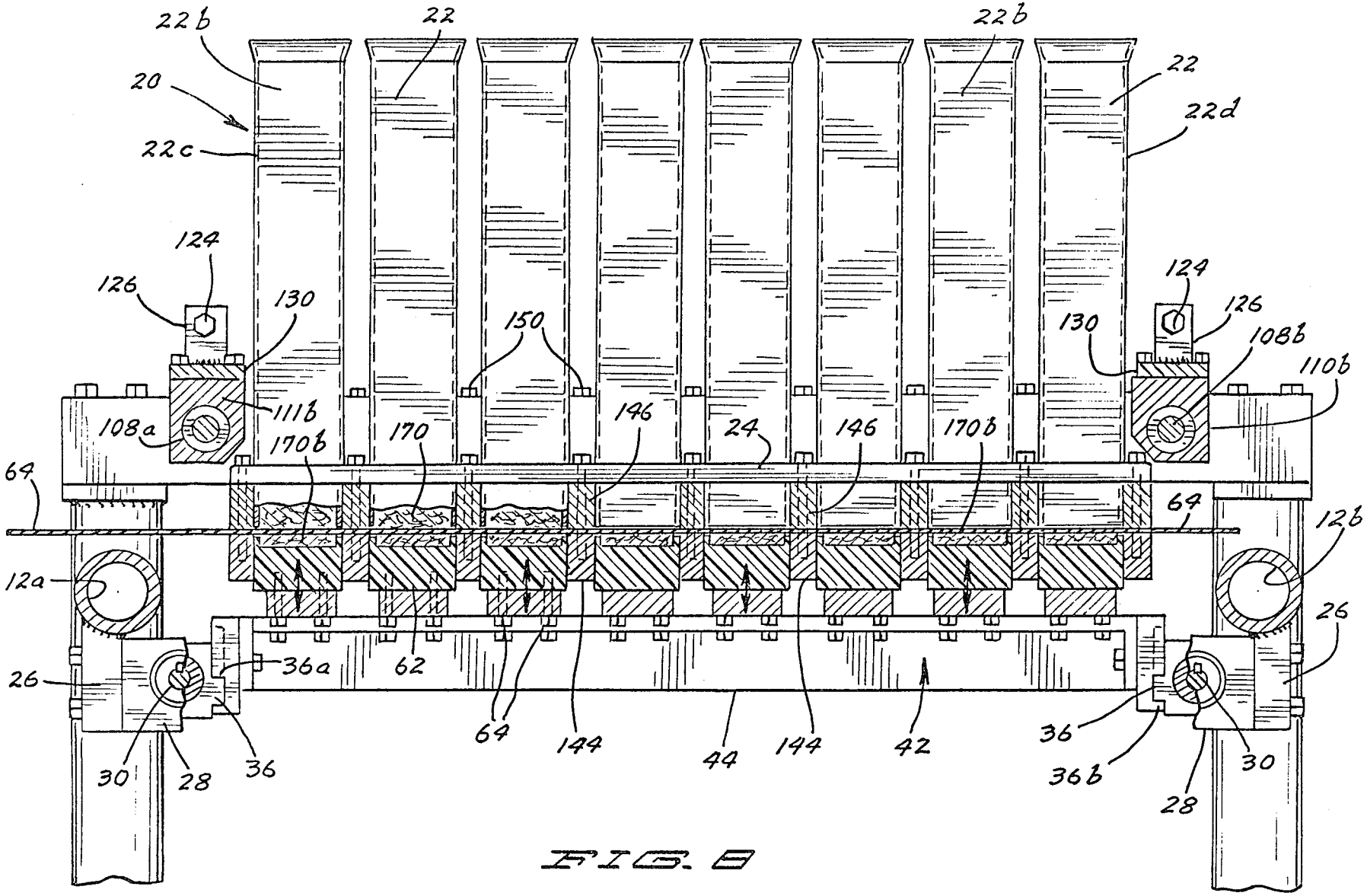
FIG. 8 is a sectional view taken in the direction of line 8—8 of FIG. 6.

At this stage of the description, it should be appreciated that the block 110*a* appearing at the left in FIG. 6, and also in FIG. 7, is movable or adjustable with respect to the cam plate 102. The other block 110*b*, this being the one at the right in FIGS. 6 and 7, is fastened rigidly to the underside of the cam plate 102. The block 110*a* at the left is adjustable for a purpose that will be better understood as the description progresses. However, an adjustment screw or bolt 124, there also being a second such bolt at the other side of the apparatus 10, is threadedly mounted in an upstanding lug 126 welded to the upper surface of the cam plate 102. A second upstanding lug 128 is welded to a pusher pad 130 having four slots 132 formed therein, one of which slots 132 can be seen in FIG. 6 because the pad 130 is broken away to expose the slot to view. There are underlying slots 134 contained in the cam plate 102, one of which can be noted in FIG. 6. Inasmuch as there are four slots 132 and four slots 134, four bolts 136 are employed, these bolts extending downwardly through the various slots 132, 134 into the particular bearing block 110*a* shown at the left in FIGS. 6 and 7. Consequently, when the adjusting screw or bolt 124 at each side of the apparatus 10 is adjusted, it causes the blocks 110*a*, 111*a* at the left, there being one at one side and one at the other side of the apparatus 10, to be moved relatively to the cam plate 102 with the consequence that the angle iron 120 is adjusted. Since the pusher pins 122 extend downwardly from the horizontal flange 120*b* of the angle iron 120, it follows that all of the pusher pins are simultaneously adjusted when adjusting the two adjusting screws or bolts 124.

Having mentioned the series of pusher pins 122, an equal number of pusher units 138 will be referred to. All of the pusher units 138 can be seen in FIG. 1. However, the cross sectional makeup appearing in FIGS. 6 and 7 of the particular pusher unit 138 there depicted will better illustrate the construction and function of these various pusher units 138. Thus, each pusher unit is formed with a flat strip section or shank 138*a* which is slidable in the groove 62*b* formed in the plastic block or anvil 62 with which the particular pusher unit 138 now being described is associated. It will be appreciated that the inturned flanges 62*c* which are integral with the block or anvil 62 overlie the side margins of the shank 138*a* and the entire pusher unit 138 is thus tracked along the upper surface of the anvil 62. Each pusher unit 138 also includes an upstanding cup 138*b* having a sleeve bearing 138*c* press fitted therein. The various pusher pins 122 extend downwardly into the various sleeve bearings 138*c* and hence the rectilinear motion of the cam plate 102 is transmitted via the angle iron 120 and the various pusher pins 122 to the various pusher units 138. Once again, the function of the pusher units 138 is better left for subsequent discussion. All that need be realized at this point is that the various pusher units 138 are synchronized with the movement of the blade 64.

One of the strips 24 anchoring the magazine 20 in place, there being two such strips 24 as can be understood from FIGS. 1, 6 and 7, overlies a transverse finger or ledge 140 on a strip 141 that spans the width of the magazine 20 so as to provide a void or notch 142 which receives the knife edge 64*a* therein, as specifically depicted in FIGS. 6 and 7. The purpose of the finger 140 will be better understood when considering the operation of our apparatus 10.

Whereas the blade 64 is intended to be moved relative to the lower end of the various tubes 22 constituting the magazine 20, actually the upper surface bearing against the bottom edge of each tube 22, it will be recognized that a blade of the length such as to underspan the various tubes 22 would be flexed or become bowed during its cutting action if not restrained or reinforced. Since the various tubes 22 are laterally spaced, use of the space between adjacent tubes 22 is made for preventing any deflection of the blade 64. More specifically, it will be noted from FIG. 8 that the blade 64 is literally clamped at spaced locations therealong which reside between adjacent tubes 22. In this regard, there is an underlying strip 144 and an overlying strip 146. These strips 144, 146 are also visible in FIG. 1, and the strips 146 can be viewed in FIG. 2. The ends of the strips 144, 146 are anchored or clamped to the mounting bars 18*a*, 18*b* by bolts 150. A spacer 151 is employed at the right in FIG. 7. The ends of the transverse strips are attached by additional bolts to the previously mentioned mounting bars 18*a* and 18*b* which support the magazine 20. Consequently, the blade 64 is clamped securely at spaced intervals therealong determined by the relative locations of the various tubes 22 of the magazine 20. The aspect of the matter to bear in mind is that the knife edge 64*a* is free to pass beneath the various tubes 22 constituting the magazine 20.

A conveyor assembly denoted generally by the reference numeral 154 has a number of endless wire belts 156 entrained about gears 158*a* at one end and 158*b* at the other end. One gear 158*a* is visible in FIGS. 6 and 7, and is mounted on a driven shaft 160 having a driven pulley 162 keyed thereto. A timing belt 164 extends about the pulley 162 and also about a drive pulley 166 (FIG. 2) which is rotated by a hydraulic motor 168.

The magazine 20, which in the illustrative situation is composed of eight vertically mounted tubes 22, is intended to receive a number of frozen fish logs or columns, actually eight, so that they can be simultaneously cut by the cutter blade 64. As can be perceived from FIG. 2, which is a top plan view of our apparatus 10, one such frozen fish log or column 170 is contained in each of the tubes 22. It will be appreciated that the cross section of each log or column 170 is rectangular, corresponding closely to the rectangular configuration of the tubes 22. However, when cross sections differing from the rectangular one are desired, then an appropriately shaped insert (or inserts) is suspended within each tube 22 to fill up the remaining void. In this way, square, triangular, trapezoidal and other shapes can be obtained from similarly configured columns or logs.

The lower end portion of one of the rectangular frozen fish logs 170 can be seen in FIG. 6, and is identified by the reference numeral 170*a*. From FIG. 6, the cutter blade 64 being retracted in this view, it can be observed that the lower end portion 170*a* of the particular fish log 170 seen in FIG. 6, rests directly on the upper surface of the shank 138*a* belonging to the particular pusher unit 138 appearing in cross section in this view. Whereas the relationship depicted in FIG. 6 exists when the various frozen fish columns 170 are inserted into the various tubes 22 via their open upper ends, the relationship is successively repeated as the columns or logs move downwardly in their respective tubes when the lower portion thereof is severed as seen in FIG. 7.

More specifically, the blade 64 has been advanced at the proper elevation with respect to the lower end of the fish log so as to sever or cut a portion labeled 170*b*. The portion 170*b* has a thickness determined by the particular elevation of the table assembly 44.

Inasmuch as the manner in which the table assembly 42, more specifically its base table 44, is raised and lowered has been explained heretofore, this being through the agency of the hand wheel 48, it is not believed necessary to recapitulate at this time. It is important, though, to appreciate that the various plastic blocks or anvils 62 are securely anchored by the bolts 64 to the base table 44 so that they are elevated or lowered, as the case may be, whenever the hand wheel 48 is manually turned or rotated. When the base table 44 is raised, then the blocks or anvils 62 are raised, and also the various pusher units 138 are raised a like amount. Although believed evident from FIGS. 6 and 7, the vertical movement just alluded to can be achieved without interference, for the pusher pins 122 do not extend to the bottom of the pusher cups 138*b*. In other words, the various pusher pins 122 are free to be moved upwardly and downwardly within the sleeve bearings 138*c* that are press fitted into the cups 138*b*. It is important to understand, however, that the vertical adjustment can be realized at any time and the apparatus need not be stopped in order to adjust the height of the table assembly 42 with respect to the lower ends of the tubes 22 forming the magazine 20.

One of the advantages derivable from the apparatus 10 is its capability to sever relatively thick portions 170*b* from the lower ends 170*a* of the various frozen columns or fish logs 170. When it is taken into account that the thickness of such portions 170*b* are on the order of from 7/32 to 7/8 inch, it should be readily apparent that the apparatus 10 must be capable of withstanding severe loads and reactive forces. Furthermore, the width of such fish portions 170*b* are approximately 2½ inches and their length 3⅛ inches, it follows that a considerable mass must be severed and that severe forces are involved in performing or effecting such a cutting action.

Owing to what has been already explained, it is believed evident that the cutter blade 64 is driven at an angle, actually approximately 30°, as its knife edge 64*a* literally slices across the various lower ends 170*a* of the fish logs or frozen columns 170 contained in the magazine 20. Attention is once again directed to the arrows 66 and 68. In this regard, the arrow 66 represents the direction taken by the knife 64 when effecting a cut, that is, when it is having its knife edge 64*a* forced into the various frozen columns 170, whereas the arrow 68 denotes the reverse travel or retraction of the blade 64. It is also believed obvious from what has already been described that the drive mechanism 82, as best understood from FIGS. 1 and 5, effects the foregoing blade movement. The hydraulic motor 84 merely rotates the counterweights 94*a* and 94*b* so that the connecting arms 96*a* and 96*b* through the agency of the yoke or tie strip 101 move the blade supports 70*a* and 70*b* in the direction of the arrows 66 and 68, constrained to traverse this angular path by virtue of the bearing shafts 78*a* and 78*b*.

Tracing the cutting action in a little more detail, it is to be remembered that the lower end 170*a* of each frozen column or log 170 rests on the upper surface of the pusher unit shank 138*a*. Due to the thickness of the table assembly 44 as determined by the thickness of the base table 42 and the thickness of the relatively thick plastic blocks or anvils 62, it follows that the table assembly 44 effectively resists any deformation downwardly caused by the movement of the blade 64 through the lower end 170*a* of the various columns or logs 170 in the formation of the individual portions labeled 170*b*.

Also, the blade 64 resists deflection, either upwardly or downwardly, because of the clamping strips 144 and 146. Of course, upward deflection of the blade 64 is additionally resisted by the lower ends of the magazine tubes 22. It is extremely important when severing portions 170*b* as thick as demanded in commercial practice to have the thickness uniform from portion to portion. If the thickness varies from portion to portion, then the weight varies accordingly. Not only is the weight factor virtually critical, but the appearance of each portion 170*b* is extremely important, too. Because of the tremendous forces resulting from the cutting action, the table assembly 42 must be quite massive. Although it is adjustable vertically, it is normally stationary, the blade 64 moving relatively thereto (and also the magazine 20) in effecting the severance of the various portions 170*b*.

As the blade 64 is advanced from the position depicted in FIG. 6 to that illustrated in FIG. 7, the various pusher units 138 are retracted in synchronism with the advancement of the blade 64. With the thickness of the blade 64 corresponding to the thickness of the shank 138*a*, it is believed evident from FIGS. 6 and 7 that the fish portion 170*b* being severed is simply forced downwardly by the blade 64 onto the upper surface of the plastic block or anvil 62. Whereas the progression, that is the movement downwardly of the fish portion 170*b* as it is cut is not shown, the portion 170*b* appearing in FIG. 7 is shown as clearly resting on the upper surface of the particular anvil 62 shown in this view. It is important that the withdrawal of the pusher unit 138, more specifically its shank 138*a*, be synchronized with the advancing of the blade 64 in order to avoid breakage and also to virtually eliminate any curling that would otherwise occur. In a sense, the blade 64, as it advances through the lower end of each column 170, literally irons the portion 170*b* being severed so that it has no space in which to curl.

With the foregoing in mind, it is believed that the function of the finger 140 can now be fully appreciated, for the void 142 thereabove accommodates therein the beveled knife edge 64*a* as it passes just beyond the backside of the various tubes 22, more specifically those sides labeled 22*a*. The finger 140 acts against the backside of each portion 170*b*. The support provided by the finger 140 becomes very important at the end of the cutting stroke, for it then effectively resists any fracturing or breaking off of the portion 170*b*. Stated somewhat differently, toward the end of the cutting stroke, there is very little fish mass to resist breakage and the finger 140 at this stage of the cutting action simply keeps the fish portion from breaking.

It is now believed readily apparent that the adjusting action derivable through the agency of the adjusting screws or bolts 124, there being one such bolt 124 at each side of the apparatus, enables the operator to adjust the various pusher units 138 so that the shanks 138*a* thereof are retracted in order that the free end of each shank 138*a* is directly beneath the knife edge 64*a* of the cutter blade 64. In other words, the adjusting screws or bolts 124 permit the pusher pins 122 to be shifted so that the right or free edge of the shank 138*a* appearing in FIG. 7 is in vertical alignment with the knife edge 64*a*. If there is any overlap, then it can be appreciated that the fish portion 170*b* is squeezed or crushed between the knife edge 64*a* and the overlapping portion of the blade 64 with respect to the underlying portion of the shank 138*a*. On the other hand, if there is a spacing of the right end of the shank 138*a* so that it is farther to the left and does not underlie the beveled knife edge 64*a* then portion 170*b* as it is cut is bent downwardly by the advancing knife edge 64*a* and breakage is likely to occur because there is no underlying support directly beneath the knife edge because of the displacement of the right end of the shank 138*a* relative to the knife edge 64*a*. Consequently, having the right end of the shank 138*a* juxtaposed directly beneath the knife edge 64*a* at all times is absolutely essential for severing uniform portions 170*a* from the columns or logs 170.

Describing now how the various portions 170*b* resulting from a single cutting stroke of the blade 64 are displaced or dislodged from beneath the magazine 20, the function of the various pusher units 138 will now be made manifest. Whereas on the cutting or severing stroke of the blade 64, the pusher units 138 are retracted by reason of the movement imparted to the cam plate 102, more specifically due to the action of the rollers 114 against the strip 118 of the cam track composed of the two strips 118, the rollers 114 act against the other strip 118 to advance the various pusher units 138 in the direction of the conveyor assembly 154 as the blade 64 is retracted from the position in which it appears in FIG. 7 back to the position in which it appears in FIG. 6.

As viewed in FIG. 7, the right end or edge of the shank 138*a*, this edge being directly beneath the knife edge 64*a*, acts against the now severed fish portion 170*b* to push or shove it to the right. Whereas the particular fish portion 170*b* pictured in FIG. 7 is not the first one to be cut from the log or column 170, it can be appreciated, it is believed, that the first portion (which is now on the conveyor assembly 154) is acted against by the shank 138*a* of the particular pusher unit 138 appearing in FIG. 7. Consequently, the severed portion 170*b* is pushed to the right. It should be recognized that the portion 170*b* is pushed completely from under the particular tube 22 seen in FIG. 7 so that it assumes the position of the fish portion 170*b* already displaced.

The cutting and pushing action alternates until the entire column 170 has been severed into individual portions 170*b*. There is no need to even shut down the apparatus as the height of the column 170 is reduced as a result of the successive cutting off of portions 170*b*, for all that is necessary is that an additional frozen column or log 170 be inserted into the upper end of the magazine tube 22 and it merely rests on the upper end of the log being diminished in size by reason of the portions 170*b* being sliced off the bottom end thereof.

For the sake of discussion, the region beneath the magazine 20 can be considered to be a cutting or severing station. One nicety of our invention is that the severed fish portions 170*b* are all uniformly oriented after they have been cut from their respective columns or logs 170. In this regard, each tube 22 has the previously mentioned relatively narrow sides 22*a*, 22*b* and the relatively wide sides 22*c*, 22*d*. Hence, the various fish portions 170*b* as they are displaced from beneath the various tubes 22 constituting the magazine 20 are all oriented in the same direction, that is with the longer dimension of each portion 170*b* parallel to the other. Also, each portion 170*b* as it emerges from beneath the magazine 20 is spaced with respect to its adjacent portion 170*b* owing to the lateral spacing of the individual tubes 22 with respect to each other.

Whereas each portion 170*b* when acted against by its particular pusher unit 138 is shoved against the preceding portion 170*b*, the end result is that the various portions 170*b* are advanced by acting against each other onto the conveyor assembly 154. There is no change in the orientation of the various portions 170*b* and each is introduced onto the conveyor assembly 154 in the same fashion that it leaves the magazine 20.

Although the successive fish portions 170*b* are touching each other up to the time they are moved onto the conveyor assembly 154, the conveyor assembly 154 is driven by the separate hydraulic motor 168 so that the speed of the various wire belts 156 onto which the various portions 170*c* are placed can be varied. By increasing the speed of the timing belt 64 (through the agency of the hydraulic motor 168) a spacing between the fish portions 170*b* can be accomplished so that when the portions 170*b* reach the distal end of the conveyor assembly, they are spaced appropriately for being processed. Thus, the free end of the conveyor assembly 154 can be considered to be a processing station in contradistinction to the earlier-mentioned cutting station. In actual practice, though, the conveyor assembly 154 discharges the portions 170*b* onto another conveyor constituting the beginning of one of a number of so-called "lines".

However, for the sake of facile discussion and drafting simplicity, as the various fish portions 170*b* advance on the individual wire belts 156 of the conveyor assembly 154, the open mesh of the belts 156 can be said to enable the fish portions 170*b* to be breaded and battered, or merely fried. Once again, it is important to recognize that the various portions 170*b* as they reach the free end of the conveyor assembly 154 are all oriented uniformly and this is achieved automatically with our apparatus 10. In other words, whether the further processing of the portions 170*b* is done at the end of the conveyor assembly 154 or on a conventional conveyor line, the point to be emphasized is that the successive portions 170*b* are relatively positioned or uniformly oriented so that the processing can be done. Consequently, it is believed obvious that our apparatus 10 lends itself readily to the mass production and mass packaging of fish portions. This is accomplished with virtually no waste, especially since the height of the table assembly 42 can be adjusted by means of the hand wheel 48, doing so on the fly, so to speak. Hence, when practicing our invention a highly acceptable end product can be obtained and this is done in a simple and economical manner.

We claim:

1. A method of severing frozen columns of fish or the like into individual portions comprising the steps of arranging a number of said columns in a generally parallel relation at a first location, severing portions from the corresponding ends of each column with a flat blade having a straight knife edge, said severing step including the angular advancing of said blade while maintaining said knife edge generally parallel to said columns, and moving said severed portions from said first location to a second location in the same relation in which said portions are oriented when severed in said first location.

2. A method in accordance with claim 1 in which said columns have a cross section with one dimension being greater than the other, said severing step being initiated in the direction of said greater dimension, and said moving step advances said portions with their greater dimensions generally parallel.

3. A method in accordance with claim 2 in which said cross section is rectangular, with said severing step being initiated from one narrower side of each column toward the other narrower side so that the resulting severed portions are rectangular and said moving step advances said portions with one narrower end leading the other narrower end, the narrower leading end of each portion resulting from the narrower side at which said severing step is initiated.

4. A method in accordance with claim 1 in which said columns have a rectangular cross section with two sides being narrower than the other two, said severing step being initiated from one narrower side of each column by advancing said knife edge against said one narrower side of each of said columns.

5. A method in accordance with claim 4 in which said blade is angularly advanced while maintaining said knife edge parallel to all of said one narrower sides.

6. A method in accordance with claim 5 in which said blade is advanced at an angle of approximately 30°.

* * * * *